United States Patent [19]

Kidon et al.

[11] 4,117,560

[45] Oct. 3, 1978

[54] APPARATUS FOR TREATING FLUIDS AND TREATING TABLETS THEREFOR

[75] Inventors: William E. Kidon, Chardon; Neil W. Stillman, Madison, both of Ohio

[73] Assignee: Diamond Shamrock Corporation, Cleveland, Ohio

[21] Appl. No.: 804,639

[22] Filed: Jun. 8, 1977

[51] Int. Cl.[2] ..... E03D 1/00; C02C 1/40; C02C 1/00

[52] U.S. Cl. ..... 4/321; 4/317; 4/320; 4/222; 210/195 S; 210/198 R; 422/264

[58] Field of Search ..... 4/321, 320, 317, 318, 4/319, 322, 323, 222-232; 21/58; 210/198 R, 195 S

[56] References Cited

U.S. PATENT DOCUMENTS

| | | | |
|---|---|---|---|
| 2,397,292 | 3/1946 | Salle | 21/58 |
| 2,852,140 | 9/1958 | MacLaren | 210/195 UX |
| 3,320,621 | 5/1967 | Vita | 4/321 |
| 3,472,390 | 10/1969 | Poll et al. | 4/320 X |
| 3,540,590 | 11/1970 | Schneider, Jr. et al. | 210/198 R X |
| 3,563,384 | 10/1968 | Dalaney et al. | 4/320 X |
| 3,595,786 | 7/1971 | Horvath et al. | 210/198 R |
| 3,805,957 | 4/1974 | Oldham et al. | 210/195 S |
| 3,883,427 | 5/1975 | Oldham et al. | 210/195 S |

*Primary Examiner*—Henry K. Artis
*Attorney, Agent, or Firm*—John P. Hazzard

[57] ABSTRACT

An apparatus for treating fluids especially fluids in a recirculating toilet system wherein recycled flush water is chemically treated with a sanitizing material just prior to delivery to the toilet bowl. This system is designed so that the recycled flush water must flow by a predetermined volume of soluble sanitizing tablets which resuts in a rather uniform residual of sanitizing agent in the flush water which insures complete coliform kills. The sanitizing tablets consist of buffered hypochlorite materials to which may be added a suitable coloring agent so as to make the flush water more aesthetically pleasing.

12 Claims, 3 Drawing Figures

APPARATUS FOR TREATING FLUIDS AND TREATING TABLETS THEREFOR

BACKGROUND OF THE INVENTION

This invention relates primarily to the art of sewage treatment and, more particularly, to treatment of sewage in a recirculating-type of toilet.

Toilets of the recirculating-type are commonly used on recreational vehicles and boats, and in other locations where a plentiful fresh water supply and sewage disposal facilities are lacking. These toilets include a storage chamber which is charged with a relatively small quantity of clear water and liquid from the storage chamber is recirculated through the bowl back into the storage chamber for flushing purposes. Human wastes deposited in the storage chamber mix with the initial water charge and form part of the flushing liquid thereafter.

Toilets of the type described commonly have a chemical added to the liquid in the storage chamber for destroying coliform and other bacteria in the liquid, and for reducing odor-producing gases. In other arrangements, reagents are added to the storage chamber periodically or are generated electrolytically within the storage chamber from chemicals dissolved in the liquid in the storage chamber. Previous recirculating toilets of this type have included macerating means for macerating solids in an attempt to return same to a liquid form for recirculation through the bowl for flushing purposes.

Even though sewage solids are generally decomposable to a liquid, decomposition of the solids back to liquid form takes a relatively long period of time. Macerating the solids simply creates a large amount of suspended solids in the liquid contained in the storage chamber. These solids are fed back to the bowl for flushing purposes, and coliform or the like may not be completely destroyed by chemicals in the storage chamber because it requires time for the chemicals to attack the coliform contained within the solid particles. Solids containing live bacteria build up in the flush water to cause odors and create a health hazard.

The present invention successfully overcomes the above-noted problems as well as others and provides a recirculating toilet which is simple, economical, and readily adaptable to use in many environments.

Typical of such prior art patents is U.S. Pat. No. 3,595,786. This patent describes treating fluids in a hold tank with disinfecting chemicals such as calcium hypochlorite before the liquid flush water is returned to the toilet bowl. In this patent, however, the amount of sanitizing agent dispensed to the fluid or flush water can vary widely, since the time period between flushing can vary widely, and secondly the flush liquid need not necessarily come in close proximity to said sanitizing tablets while passing through the hold or storage tank.

BRIEF DESCRIPTION OF THE INVENTION

Recirculating toilet systems are commonly found in transportation equipment wherein the weight to be carried is minimized so as to maximize energy utilization. The recirculating toilet accomplishes this by recycling the flush water rather than have fresh water available for each flushing. Such recirculating toilet systems require chemical treatment of the flush water so as to kill bacteria present therein.

The present invention accomplishes this end utilizing soluble disinfecting tablets over which is pumped the recirculating flushed liquid just prior to said flush water being pumped to the toilet bowl.

The present invention consists of a substantially rectangular storage or hold tank. The hold tank has a waste fluid inlet and a flush water outlet, said inlet and outlet being separated as much as possible from one another. The hold tank is divided into two major sections—a holding area which collects all solids contained in the waste fluid inlet and a treatment area wherein the waste fluid is chemically treated prior to being recirculated to the toilet bowl wherein it acts as flush liquid. The holding or collection area is separated from the treatment area by a series of weirs, filters and baffles. The weirs and filter are interposed between these two areas so as to prevent solids from escaping from the holding area into the treatment area of the hold tank. Preferably, there is an underflow weir which extends from the top of the tank down below the minimum liquid level in the hold tank. The underflow weir effectively prevents any floating solids from coming in contact and clogging a filter means. Thus, any waste fluid entering the hold tank through the waste fluid inlet must first flow under an underflow weir and thereafter over an overflow weir which extends upwardly from the bottom of the hold tank to a height below the minimum liquid level but above the lower extreme of the underflow weir. This overflow weir thus, in effect, prevents heavier solids from entering the treatment area. Mounted on and above the overflow weir is the filter means through which the waste fluid from the holding area of the hold tank must flow in order to enter the treatment area.

After passing through the filter means, the waste liquid may flow directly to the treatment area or can be made to wend its way around a series of baffles which elongate the flow path of the waste liquid so as to assure full elimination of bacteria.

The treatment area of the hold tank comprises a cylindrical disinfecting tablet feed mechanism which extends from the top of the hold tank substantially to the bottom thereof. The lower end of this continuous cylindrical tablet feed means has attached thereto a perforated retainer which holds the disinfecting tablets within the cylinder but allows treated waste fluid to pass up into the cylinder to effect a dissolution of said disinfecting tablets. A flush water outlet communicates with a pump for pumping said waste fluid as a flush liquid to the toilet bowl and also communicates with the interior of the cylindrical disinfecting tablet feed means. This flush water outlet is positioned somewhat above the perforated retainer on the bottom of the cylinder. With this construction, the waste fluid which is to be used as flush liquid must pass through the perforated retainer and up through and around the disinfecting tablets and out through the flush water outlet.

The narrow flow path around the disinfecting tablets effects a rather uniform chemical treatment to the flush water.

In the preferred forms of the invention, the diameter of the cylindrical disinfectant tablet feed means is such that the portion above the flush water outlet closely approximates the diameter of the disinfecting tablets while the diameter of the chamber between the flush water outlet and the perforated retainer is slightly larger so as to allow sufficient room for the liquid flow through the treatment area of the cylindrical treatment means. This required flow through the enlarged lower portion of the treatment means assures full contact between the flush liquid and the soluble disinfecting tablets. The narrowed upper portion of this cylindrical treatment means prevents flow of liquid about the other disinfecting tablets in the upper reaches of the cylinderical treating means. As disinfecting tablets are dissolved, the ones in the upper narrowed feed cylinder fall by gravity into the enlarged cylindrical treating area.

The treatment of the flush liquor results in a chlorine residual in the flush liquor which immediately begins disinfection of any waste upon its use as a flush liquor and prior to its return to the holding tank.

The disinfecting tablets used in this apparatus can be any soluble solid disinfecting materials known to those skilled in the art. However, it is preferred to employ disinfectant tablets utilizing a buffered calcium hypochlorite as the disinfecting agent. Preferably such disinfecting tablets would contain approximately 45% calcium hypochlorite, 40% by weight sodium carbonate, which acts as a buffer, about 14½% sodium chloride, which improves the tableting characteristics of the mixture, and about 0.5% of a dye such as Monastral Blue or Ultramarine Blue.

The utilization of the instant invention results in a trouble-free longer life system wherein all bacteria and noxious gases are eliminated from the flush water. Solids are essentially eliminated from passage through the toilet bowl for flushing purposes. In essence, sanitation is maximized with minimal disinfectant tablet use since the flush water is essentially treated so as to contain a residual of about 250 milligrams per liter of free available chlorine just prior to being recycled to the toilet bowl.

BRIEF DESCRIPTION OF THE DRAWINGS

While the apparatus of the instant invention may take many modified forms, a preferred embodiment will be described in detail in the specification as illustrated in the accompanying drawings wherein.

DETAILED DESCRIPTION OF THE INVENTION

In accordance with the apparatus of the instant invention, a treating agent is used to treat fluids in a manner such that the agent is dispensed into the fluid in a predetermined uniform concentration but without having to use mechanical mixers, expensive instrumentation, power sources or solutions of the agent.

The foregoing is achieved by the method of employing the present invention which consists of treating a fluid source by establishing a treatment zone for the fluid source and contacting the fluid source in the treatment zone with a treating agent for a period of time to dissolve the desired amounts of the agent in the fluid. In greater detail, the method of treating fluids, by use of the present invention, involves introducing fluid into a treatment zone, said treatment zone being a confined passageway for said fluid around a relatively fixed amount of treating agent wherein all such fluid passing through the treatment zone of necessity is in close proximity to the soluble treating agent. In this manner, a precise amount of treating agent is dissolved into the fluid as it passes through said treating zone. The fluid entering the treating zone is made essentially free from any solids by the use of various weirs and filter means. Baffle means may also be employed to elongate the flow path of the fluids through the system so that the residence time in said system is extended or made more uniform for the fluid passing therethrough.

Figure 1:
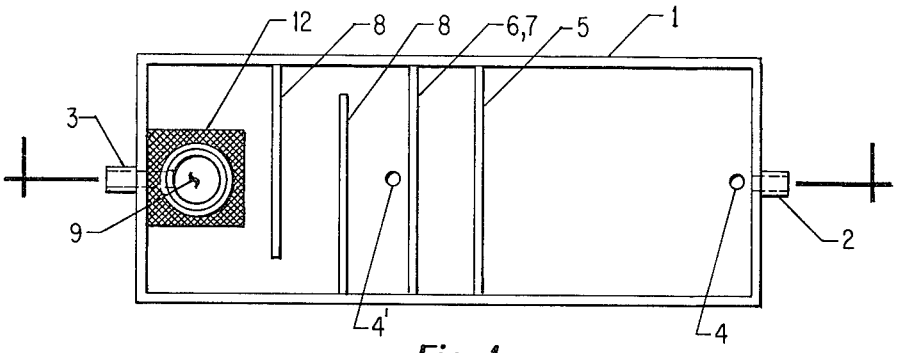
FIG. 1 is a top view of a toilet system holding tank constructed in accordance with the present invention, with the top removed for clarity of illustration.
Figure 2:
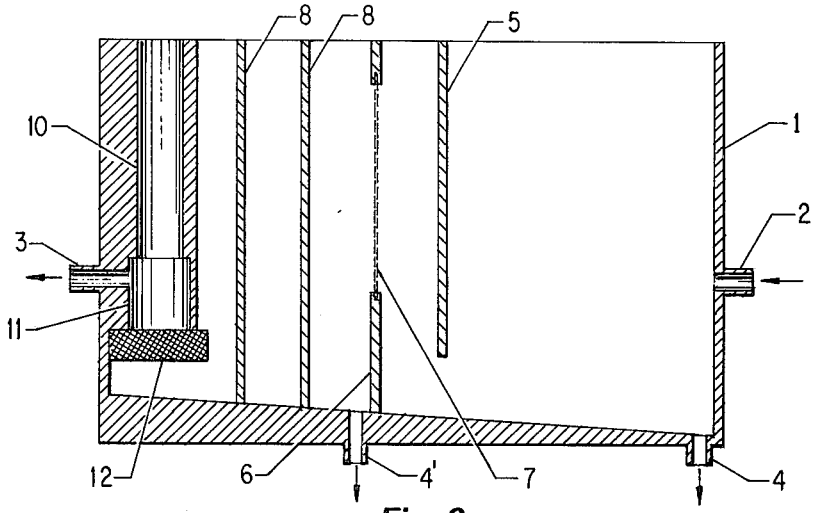
FIG. 2 is a cross-sectional plan view taken generally on line 2—2 of FIG. 1.

This invention will be more fully understood by reference to the drawings which present various embodiments of the invention. In FIGS. 1 and 2, a hold tank 1 is illustrated. Waste fluid enters hold tank 1 through waste fluid inlet 2, travels through the hold tank and exits therefrom after disinfection through flush water outlet 3. Such a hold tank will hereinafter be described in connection with a recirculating toilet system wherein the sanitized liquid exiting flush water outlet 3 is pumped therefrom to one or more toilet bowls for use as flush water when required. The flush water, along with additional refuse, leaves the toilet bowl and returns by gravity to hold tank 1 by means of waste fluid inlet 2 wherein any solids are separated while the liquid portion of the returned flush water continues through the hold tank for ultimate retreatment and reuse as flush water.

As illustrated, hold tank 1 is rectangular in cross section. Of course, hold tank 1 could be of any configuration so long as it is of sufficient capacity to meet its designed utility. Waste fluid inlet 2 and flush water outlet 3 are illustrated at oposite ends of the hold tank. The positioning of these ports again is a matter of design, it being necessary only that they be remote from one another with respect to the flow path through hold tank 1. By this is meant inlet 2 and outlet 3 could be located adjacent one another if, indeed, a baffle system required the liquid in the hold tank to flow through the entire hold tank before reaching the outlet 3.

In actual operation, flush water taken from hold tank 1 through flush water outlet 3 for use as a flush water, is treated with a disinfecting agent just prior to withdrawal from the hold tank 1 so that the flush water contains an available chlorine residual sufficient to disinfect the human waste deposited in the toilet bowl to thus maximize the time in which the available chlorine has to kill all bacteria and control odor.

When the refuse containing flush water exits the toilet bowl and returns to hold tank 1 through waste fluid inlet 2, the flush water containing the refuse enters the largest chamber within hold tank 1 wherein the flow rate of the liquid there in is minimal. This low velocity region in hold tank 1 allows heavy solids entering the hold tank to settle and remain therein so as not to interfere with the reuse of the liquid content entering hold tank 1 from being reused as flush water. To assure that solids entering hold tank 1 through waste fluid inlet 2 remain in the inlet end of the hold tank and do not enter into the treatment or discharge end of the hold tank, a combination of weirs are utilized. As best shown in FIG. 2, there is an underflow weir 5 which extends from the top of the hold tank down into the liquid in the tank at start-up which requires any materials entering through waste fluid inlet 2 to flow thereunder in order to exit hold tank 1 through flush water outlet 3. This underflow weir 5 prevents floating solids from exiting the entrance portion of hold tank 1. Downstream of underflow weir 5 is an overflow weir 6 which has the purpose of preventing heavy solids from entering the treatment area of hold tank 1. Underflow weir 5 should extend downwardly in the tank to a point below the upward extension of overflow weir 6, and said weirs should be spaced sufficiently from one another so that the flow rate of liquid upwardly between the overlapping portions of the weir are not such to draw solids with the liquid flow. At start-up of such a system, hold tank 1 would be partially filled with a fluid. Most commonly water could be used, but any other fluid would be equally applicable. Ideally, the fresh charge of water would fill the hold tank to a point above the level of overflow weir 6 and at the same time be sufficiently above flush water outlet 3 to be able to supply enough water for the initial flushing of the waste treatment system. This initial water level would also be above the lower end of underflow weir 5.

To further assure that solids do not enter the treatment area of hold tank 1, overflow weir 6 has affixed thereto a filter means 7 which extends from the top of overflow weir 6 to the top of hold tank 1. Filter means 7 can be any known filter means. However, it is preferred that the filter consist of vertical inert strips slightly separated from one another. These can be typically made from plastic materials which are commonly available. It should be noted that such vertical filter arrangements constantly present new filter area as the level of waste in the hold tank increases. Thus filter blinding is never a problem.

Preferably, hold tank 1 has a sloped bottom with the lowest points in hold tank 1 having clean-out openings 4 and 4' through which the contents of the hold tank 1 are periodically discharged. Clean-out opening 4 is the primary clean-out opening through which most of the wast contained in hold tank 1 is discharged. Clean-out opening 4' would normally not be utilized unless it be desired to completely empty hold tank 1 or in the case of a malfunction where solids encroached into the treating area of the hold tank. In normal operation, when it was desired to empty hold tank 1, clean-out opening 4 would be used as a drain for the solid and liquid waste in hold tank 1. As the liquid level in the hold tank 1 dropped, the liquid in the treatment area of hold tank 1 would flow back through filter 7 into the solid retaining area of hold tank 1, thus backwashing the filter 7.

The disinfected liquid passing through filter 7 then approaches the treatment area. The treatment area, in essence, consists of a confined passage over soluble disinfecting tablets before exiting hold tank 1 via flush water outlet 3. Interposed between the treatment zone and the filter 7 are shown baffles 8. These baffles are not required but are preferred in order to increase the minimum residence time of all of the liquid by increasing the flow path thereof. As shown in the drawings, the baffles are perpendicular to the sides of hold tank 1, but in actual practice it would be best if baffles 8 were angled slightly in the direction of the slope of the bottom of hold tank 1 to assure proper drainage. At the conclusing of each flushing, there is a backflow of flush water from the pumping means back through the treatment cylinder which further chlorinates the flush water. The baffles tend to keep this super chlorinated flush water in the area of the treatment chamber and thus further assure complete disinfection.

The treatment zone of hold tank 1 is adjacent flush water outlet 3 and as illustrated in FIGS. 1 and 2, consists of a cylindrical means for both feeding disinfecting tablets (feed cylinder 10) and a treatment area (treatment cylinder 11). Feed cylinder 10 has an inside diameter just slightly larger than the tablets utilized in disinfecting the flush water. The lower end of feed cylinder 10 abuts the treatment cylinder 11. Treatment cylinder 11 has a slightly larger diameter than feed cylinder 10 so as to assure sufficient openings through the treatment cylinder to allow for the passage of liquid therethrough on its way to flush water outlet 3 which communicates to the interior of treatment cylinder 11 adjacent feed cylinder 10. The lower end of treatment cylinder 11 is terminated by a perforated retainer 12 which retains the feed disinfecting tablets in the treatment cylinder 11 and feed cylinder 10. At startup, a sufficient number of disinfectant tablets would be fed into feed cylinder 10 so that they would stack one upon the other and completely fill treatment cylinder 11 and extra disinfecting tablets would remain in feed cylinder 10 to be fed by gravity upon dissolution of the disinfecting tablets in treatment cylinder 11.

When utilizing disinfecting tablets containing 50% calcium hypochlorite and having the dimensions of 2½" diameter by 1" thick, we have found that the height of the treating cylinder 11 need only be such as to accommodate four disinfecting tablets to assure a residual chlorine content in the flush water of at least 250 milligrams per liter. This concentration of residual chlorine in the flush water has been found sufficient to effect a full kill of coliform bacteria in recirculating toilet operations.

Feed cylinder 10 and treatment cylinder 11, as illustrated in FIG. 2, can consist of a single cylinder of the same diameter although such is not the preferred form of the instant invention. Flow of fluid through the treating zone would still be predominantly from the inlet end through the perforated retainer 12 on through flush water outlet 3. Liquid contacting the disinfecting tablets in the cylinder above the flush water outlet 3 would be relatively still and thus dissolution of the disinfecting tablets in the feed portion of the cylinder would be minimal although higher than the illustration as shown in FIG. 2 wherein the feed cylinder portion of the cylinder would be restricted in diameter so as to closely confine the disinfecting tablets located therein.

As described, the treatment chamber and the feed cylinder have been described as cylindrical, however, as is obvious to those skilled in the art, the shape of the treatment chamber is immaterial as tablets of any shape, whether it be triangular, rectangular, square or the like could be manufactured and utilized. It would only be necessary that the configuration of the feed mechanism as well as the treatment cylinder conform to the shape of the tablet chosen.

Figure 3:
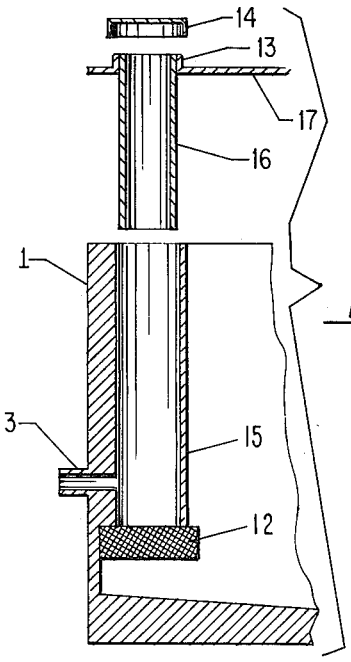
FIG. 3 shows still another arrangement in expanded form for treating the flush water.

FIG. 3 shows another illustration of a variation on the feed and treatment portion of the apparatus of the instant invention. In this illustration, hold tank 1 near flush water outlet 3 contains a cylinder 15, the lower end of which is closed with perforated retainer 12. Lid 17, which closes the top hold tank 1, has attached thereto a cylinder whose outside diameter is slightly smaller than the inside diameter of cylinder 15. The inside diameter of cylinder 16 is such as to closely approximate the outside diameter of disinfectant tablets utilized in the apparatus. Cylinder 16 is adapted to slide downwardly within cylinder 15 when lid 17 is placed on hold tank 1. When in position, cylinder 16 extends downwardly within cylinder 15 to a point just above flush water outlet 3. Thus, cylinder 16 restricts the flow of liquid passing through the treatment zone from entering and dissolving the tablets contained in the cylinder 16 during operation of the apparatus. Cylinder 16 terminates at a point above the lid 17 and can contain on its outer edge threads adapted to accommodate threaded closure 14.

The simplest and least expensive means of disinfecting waste materials other than direct chlorine production by electrolysis in chemical disinfection. The problem with typical chemical disinfectants is their extreme environmental toxicity. This makes disposal of waste from toilet systems a much more difficult problem. In addition, typical disinfectants in most systems are added in toto and do not provide adequate disinfection capacity for bacterial control. With this in mind, the present recirculation toilet system was designed. With each flush additional disinfectant is provided by the dissolution of the disinfectant tablets in the treatment cylinder.

Although any type of disinfecting tablets could be utilized in the instant apparatus, those containing heavy metals are not preferred due to toxicity inherent with their use. Calcium hypochlorite tablets can also be used. However, tests using calcium hypochlorite materials reveal that chlorine gas was liberated from the system. At a high pH around 10, no free chlorine is given off. However, the reaction of urea introduced with the human waste reacts rapidly causing a rapid pH decrease. At lower pH's, for example around 7, other reactions take place which result in the evolution of chlorine. It has been found that these undersirable side reactions can be avoided if the pH of the solution is maintained at higher levels. The present invention avoids the lower pH's by the utilization of buffering agents in the tablet formulation and this does not interfere with the amount of hypochlorite available for disinfection.

Tablets made from 40–60% by weight calcium hypochlorite with the remainder being the buffer selected from materials such as sodium carbonate, have proved satisfactory in repeated tests as such tablets prevent liberation of chlorine gas and leave the appropriate residual chlorine in the flush water to effectively kill all bacteria. One drawback, however, with such formulation is the physical stability of the tablet. It has been found that the physical stability has been improved when sodium chloride is added to the mixture of hypochlorite and buffer prior to tableting. Sodium chloride present in a weight percent of from 10–20% has proven most satisfactory with the amount of sodium chloride preferred being about 15% by weight. When sodium chloride is thus used, the formulation results in a harder, more stable tablet with excellent chlorine residuals.

Several dye or pigment materials can be added to the formulation to give the recirculating flush water more aesthetic appeal. Our preferred coloring materials are Ultramarine Blue and Monastral Blue and both are extremely effective up to approximately 1% by weight. Higher amounts of colorant can be used but with no additional benefit. Preferably, the colorants are present in the range of 0.5 to 1.0 weight percent.

Thus, when a colorant is utilized in the tablet formulation, the components and range of composition would be as follows:

| | |
|---|---|
| Calcium Hypochlorite | 40–60 weight percent |
| Sodium Carbonate | 40–60 weight percent |
| Sodium Chloride | 10–20 percent |
| Colorant | 0.25–5 weight percent |

The preferred composition for the disinfecting tablets are:

| | |
|---|---|
| Calcium Hypochlorite | 40% |
| Sodium Carbonate | 45% |
| Sodium Chloride | 14% |
| Colorant | 1% |

Such disinfecting tablets result in complete bacterial disinfection, appropriate pH control, odor control, and an acceptable appearance when utilized in the apparatus of the instant invention.

Because of the utility and relatively simple nature of the design of the apparatus of the present invention, the invention can find adaption in other areas of application such as dispensing low-solubility fertilizers or biocides in irrigation waters or aqueous soils such as rice paddies or swamps. These applications also include dispensing flocculents, dispersants, corrosion or scale inhibitors, medicaments for animal or human health, animal food supplements and the like into fluid systems.

In the drawings and specifications there has been set forth preferred embodiments of the instant invention and illustrative uses thereof and, although specific terms are employed, they are used in a generic and descriptive sense only, and not for purposes of limitation, the scope of the invention being defined in the claims.

What is claimed is:

1. An apparatus for treating fluid which comprises a container for temporarily receiving a fluid therethrough, said container including an inlet means for introducing the fluid into said container, and an outlet means for discharging the fluid from said container, at least one holding means for a treating agent, the holding means being in open communication with said outlet means, with the fluid in said container and with the exterior of the container for recharging the treating agent, said holding means having the treating agent therein exposed to contact with the fluid and requiring passage of said fluid through said holding means in close proximity to the treating agent before exiting via the outlet means, and a baffle means interposed between said inlet means and said holding means, said baffle means comprising an underflow weir associated with a downstream overflow weir wherein the fluid passing under the underflow weir must first rise before going over the overflow weir.

2. The apparatus of claim 1 wherein at least one additional baffle means is interposed between said means for introducing the fluid into said container and the holding means, thereby increasing the minimum fluid retention time in said container.

3. The apparatus of claim 1 wherein the treating agent is for treating an aqueous fluid and the agent is a buffered metallic hypochlorite.

4. The apparatus of claim 1 wherein the treating agent is for treating an aqueous fluid and the agent consists of tablets containing about 40 to 60 weight percent metallic hypochlorite, about 40 to 60 weight percent metallic carbonate as a buffer, about 10 to 20 weight percent metallic chloride and about 0.25 to 5 weight percent of a soluble colorant.

5. In a recirculating toilet system having a bowl, a holding tank, means to circulate flush liquid and waste from said bowl to said holding tank and means to recirculate liquid from said holding tank to said bowl to act as flush water, the improvement comprising a holding tank having an inlet means and outlet means having associated therewith a flush water treating means containing a treating agent which consists of a chamber within said holding tank which opens to the exterior of said holding tank above the liquid level in said holding tank for recharging treating agent thereto, said chamber also opens to both the interior of the holding tank and said outlet means below the liquid level in said holding tank so that flush water recirculating to said bowl must first pass through said chamber in close proximity to said treating agent, said holding tank having baffle means interposed between said inlet means and said outlet means to prevent any solid waste from reaching said chamber.

6. The recirculating toilet system of claim 5 wherein said baffle means comprises an underflow weir associated with a downstream overflow weir wherein the flush water passing under the underflow weir must first rise before going over the overflow weir.

7. The recirculating toilet system of claim 6 wherein a filter means is mounted atop said overflow weir so that all flush water passing over said overflow weir must pass through said filter means and, as the liquid level in said holding tank rises, new filter surface is available for filtering.

8. The recirculating toilet system of claim 7 wherein at least one additional baffle means is interposed in said holding tank between said overflow weir and said chamber increasing the flow path of said flush water in said hold tank thereby increasing minimum retention time therein.

9. The recirculating toilet system of claim 8 wherein the treating agent for treating said flush water is a buffered metallic hypochlorite.

10. The recirculating toilet system of claim 5 wherein the treating agent for treating said flush water consists of tablets containing about 40 to 60 weight percent metallic hypochlorite, about 40 to 60 weight percent metallic carbonate as a buffer, about 10 to 20 weight percent of a metallic chloride and about 0.25 to 5 weight percent of a soluble colorant.

11. The recirculating toilet system of claim 5 wherein said treating agent consists of a plurality of tablets in said chamber, said chamber having a treating area between said opening to the interior of said holding tank and said opening to said opening to said outlet means, said treating area of said chamber having a cross-sectional area sufficient to accommodate said tablets and also to allow required flush water flow around said tablets, said chamber also having a tablet feed area above both the openings to the outlet means and the interior of the holding tank, said tablet feed area being restricted in cross-sectional area to just accommodate said tablets being held in reserve for disinfecting purposes, said upper restricted cross-sectional area portion of the chamber being accessible through the top of the holding tank to permit recharging of said tablets as required.

12. The recirculating toilet system of claim 11 wherein said treating area portion of said chamber extends upwardly to a point beyond said openings above the maximum liquid level in said hold tank and a second chamber means associated with said holding tank top is adapted to be inserted into said upward extension of said treating area portion of said chamber to form the tablet feed area of said chamber.

* * * * *